US012116742B2

(12) United States Patent
Mulder

(10) Patent No.: US 12,116,742 B2
(45) Date of Patent: Oct. 15, 2024

(54) BOAT DOCKING SYSTEM

(71) Applicant: Eric P. Mulder, Caledonia, MI (US)

(72) Inventor: Eric P. Mulder, Caledonia, MI (US)

( * ) Notice: Subject to any disclaimer, the term of this patent is extended or adjusted under 35 U.S.C. 154(b) by 422 days.

(21) Appl. No.: 17/563,452

(22) Filed: Dec. 28, 2021

(65) Prior Publication Data

US 2022/0205203 A1 Jun. 30, 2022

Related U.S. Application Data

(60) Provisional application No. 63/131,481, filed on Dec. 29, 2020.

(51) Int. Cl.
*E02B 3/24* (2006.01)
*B63B 21/00* (2006.01)

(52) U.S. Cl.
CPC ..... *E02B 3/24* (2013.01); *B63B 21/00* (2013.01)

(58) Field of Classification Search
CPC ..... E02B 3/00; E02B 3/24; B63B 21/00
USPC ..... 114/230.1
See application file for complete search history.

(56) References Cited

U.S. PATENT DOCUMENTS 4,073,255 A * 2/1978 Paul ..... E02B 3/20 114/221 R
4,082,054 A * 4/1978 Bruner ..... B63B 21/00 114/230.29
6,205,944 B1 * 3/2001 Dierksen ..... B63B 21/00 114/230.1

* cited by examiner

*Primary Examiner* — Lars A Olson
(74) *Attorney, Agent, or Firm* — Gardner, Linn, Burkhart & Ondersma LLP

(57) ABSTRACT

A deployable boat docking system eases the boat docking process, particularly when just one person is docking the boat. The boat docking system includes a frame that is coupled to a dock, and an arresting panel, such as a net, that is attached to the frame. During the boat docking process, the net captures the boat by receiving a protrusion that is attached to the boat. The boat docking system then holds the captured boat in close proximity to the dock to allow the boat's operator to secure the boat to the dock through secondary means, such as tying the boat to the dock with a rope.

20 Claims, 12 Drawing Sheets

BOAT DOCKING SYSTEM

CROSS REFERENCE TO RELATED APPLICATIONS

The present application claims the benefit of U.S. provisional application Ser. No. 63/131,481, filed on Dec. 29, 2020, which is hereby incorporated herein by reference in its entirety.

FILED OF THE INVENTION

The present invention relates to systems and methods for docking boats and other watercraft.

BACKGROUND OF THE INVENTION

It is common to "dock" or secure boats and other watercraft to a dock when the watercraft are not in use. The process of docking a boat can present challenges to even an experienced boat operator, and typically involves simultaneously driving the boat up to and alongside a dock in a controlled fashion, while also executing some method of securing the boat to the dock. Ideally, this process should be carried out by at least two people: a boat operator and either a boat passenger or a person standing on the dock. The boat operator can control the speed and position of the boat relative to the dock, and the passenger or other assistant can secure the boat to the dock when the boat comes into close proximity with the dock. The process of docking a boat is more difficult when only an individual boat operator is attempting to dock the boat. This difficulty is amplified when the water conditions are rough or wavy, or if the weather is windy or otherwise inclement.

SUMMARY OF THE INVENTION

The present invention provides a method and system for docking a boat, which is particularly well-suited for a solo boat operator that is attempting to dock a boat. A frame-supported net is designed to catch or ensnare a boat during the docking process. The frame is rotatably coupled to a dock. The boat operator navigates a protrusion connected to the boat into the net. The net then deforms around the protrusion, thereby capturing the boat. While the boat is still captured by the net, the frame rotates until the forward momentum of the boat is absorbed and terminated so that the boat is essentially stopped in close proximity to the dock. The boat remains captured by the net as the boat comes to rest alongside the dock. The boat operator may then exit and fully secure the boat to the dock by other means, such as ropes.

According to one form of the present invention, the boat docking system includes a frame which includes laterally-extending portion that is coupled to a fixed object, such as a dock or dock post, by a connector. A net is attached to the frame and includes an opening adapted to receive a protrusion attached to a boat.

In one aspect, the frame includes a vertical post and a lateral arm rotatably coupled together. The vertical post of the frame is coupled to the dock by the connector. The net is attached to and supported by both the vertical post and the lateral arm of the frame.

In another aspect, a cap rotatably couples the vertical post and the lateral arm together. The cap includes a series of detents that allow the lateral arm of the frame to be selectively adjusted and movably secured into to a deployed position for use or a non-deployed position for storage. For example, when use is desired, the boat docking system can be deployed by rotating the lateral arm of the frame perpendicular to the dock where it is lightly retained in place by a perpendicular detent. This allows the lateral arm of the frame to remain in its deployed (perpendicular) position until the user manually adjusts the lateral arm of the frame out of its perpendicular detent or until sufficient force is applied to the lateral arm, such as by a boat being received and captured by the net. The perpendicular detent that lightly retains the frame in the deployed position ensures that typical wind, waves, and other natural forces will not move the lateral arm of the frame into a non-deployed position while the boat is away from the dock. Therefore, while in the deployed position, the boat docking system will be ready for use upon the arrival of the boat. When the boat docking system is not in use it can be adjusted into a non-deployed position, whereby the lateral arm of the frame is rotated parallel to the dock and is lightly retained in a non-deployed (parallel) position by a parallel detent.

In yet another aspect, both the vertical and lateral position of the frame can be selectively adjusted.

In still another aspect, the net is attached to the frame so that the net can break away from the frame under sufficient downward or lateral force, such as if a person were to climb or play on the net, or if a boat were to approach with too much speed and energy that could damage the frame or dock.

In a further aspect, the net may be made of a rigid material, or have a weight or a rigid material attached to it, so that it better resists deformation in windy conditions.

In yet a further aspect, the rotation of the lateral arm of the frame can be controlled electronically by using a controller to engage a motor to rotate the lateral arm of the frame.

In still another form of the present invention, a boat docking system includes a frame that is coupled to a dock by a connector. The connector includes a series of detents that allow the frame to be selectively deployed for use by rotating the frame out perpendicular to the dock, in which the frame becomes releasably retained at a perpendicular detent, or when not in use, the frame can be rotated back in parallel to the dock, in which the frame becomes releasably retained at a parallel detent. An arresting panel that defines an opening is attached to and supported by the frame. A protrusion attached to the boat is adapted to be received by the opening in the arresting panel.

Thus, the boat docking system and method of the present invention enables a solo boat operator to more safely and easily dock a boat, particularly if no one else is available to assist. This is accomplished by deploying a frame with an attached net that captures and holds a boat in close proximity to a dock during the docking operation.

DESCRIPTION OF THE PREFERRED EMBODIMENTS

Figure 1A:
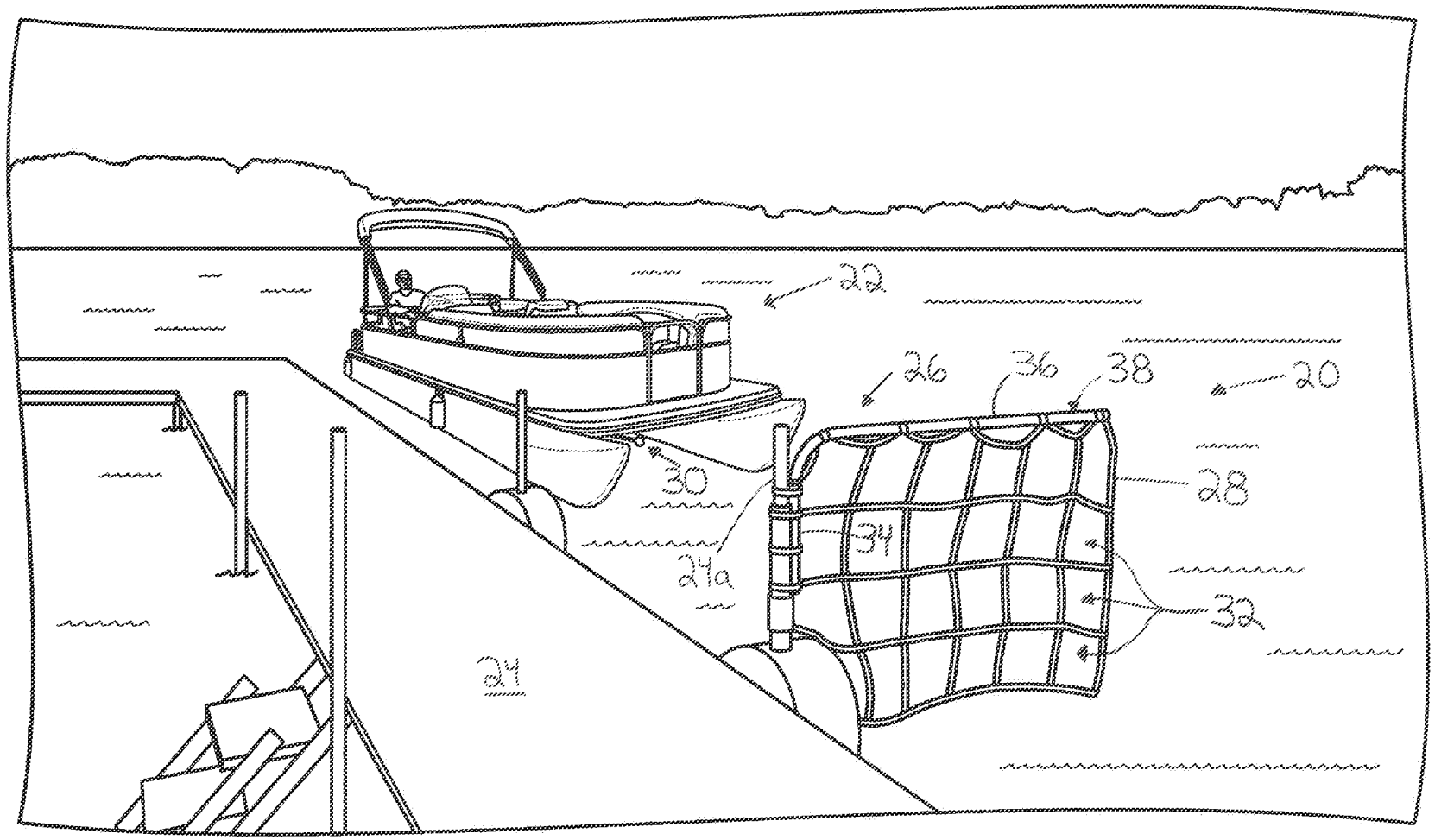
FIGS. 1A-1E are a series of perspective views of a boat docking system in accordance with the present invention, shown mounted to a dock and depicting a boat approaching and being captured by the boat docking system in accordance with a method of the present invention.
Figure 1B:
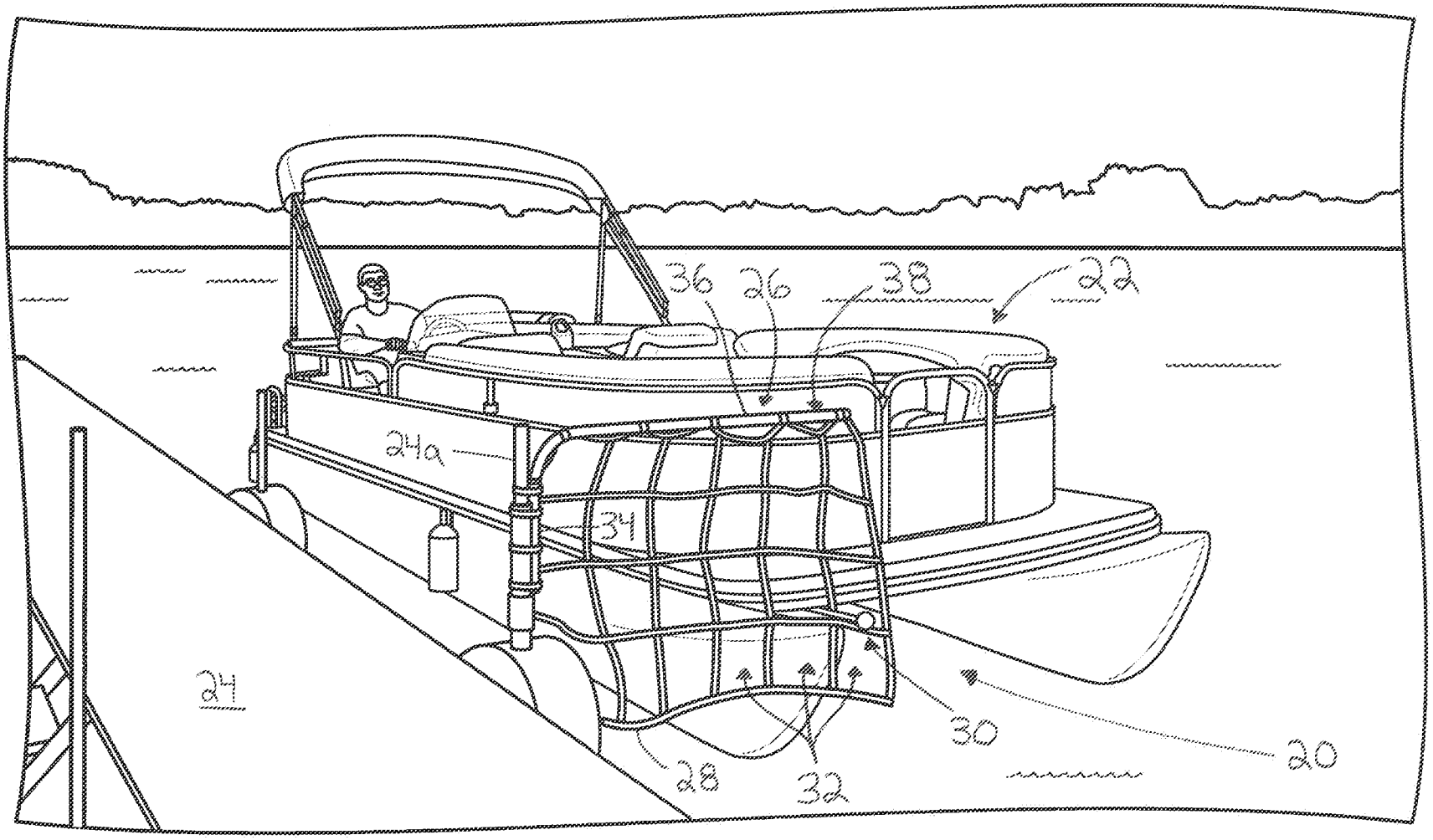
Figure 1C:
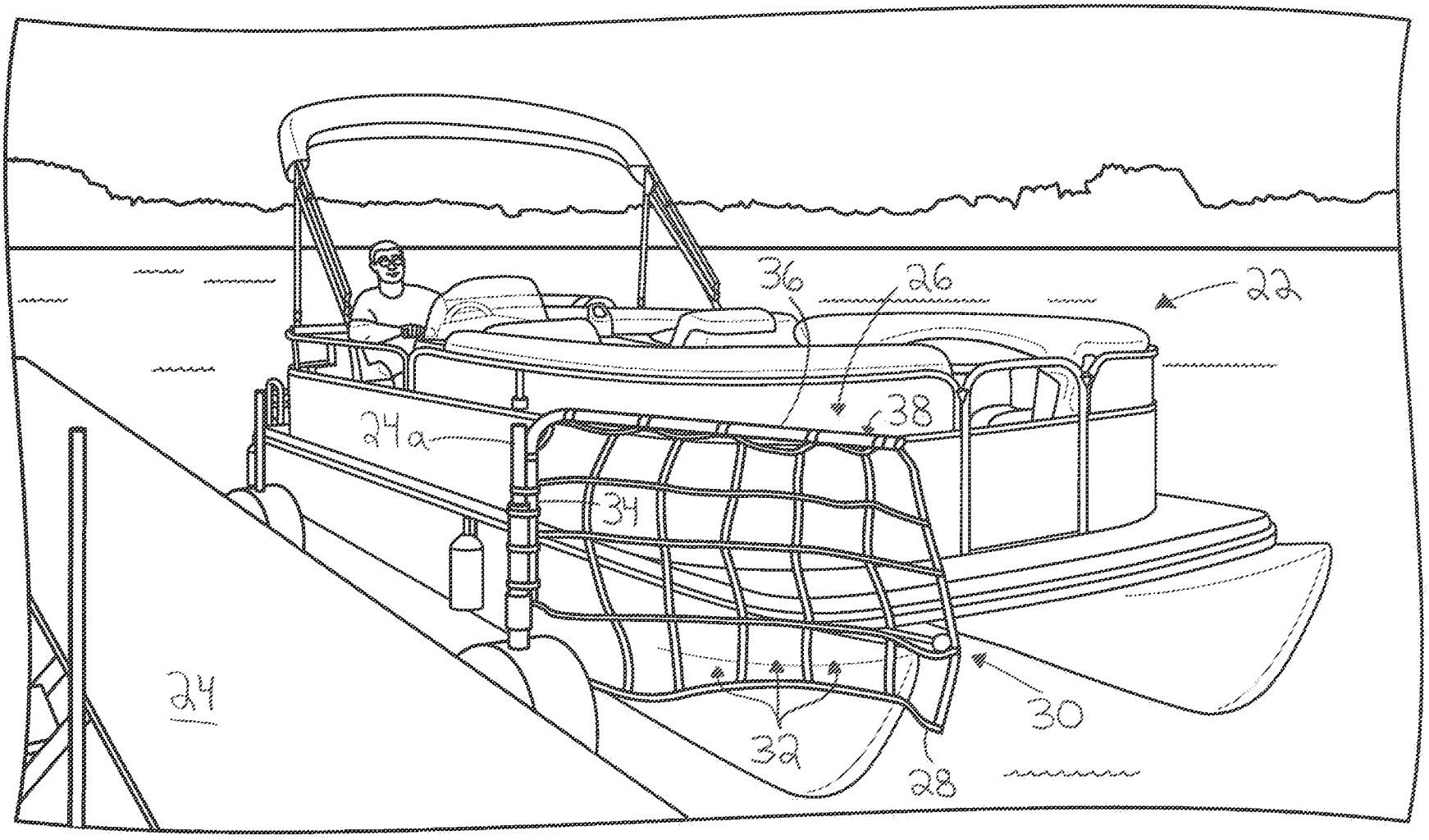
Figure 1D:
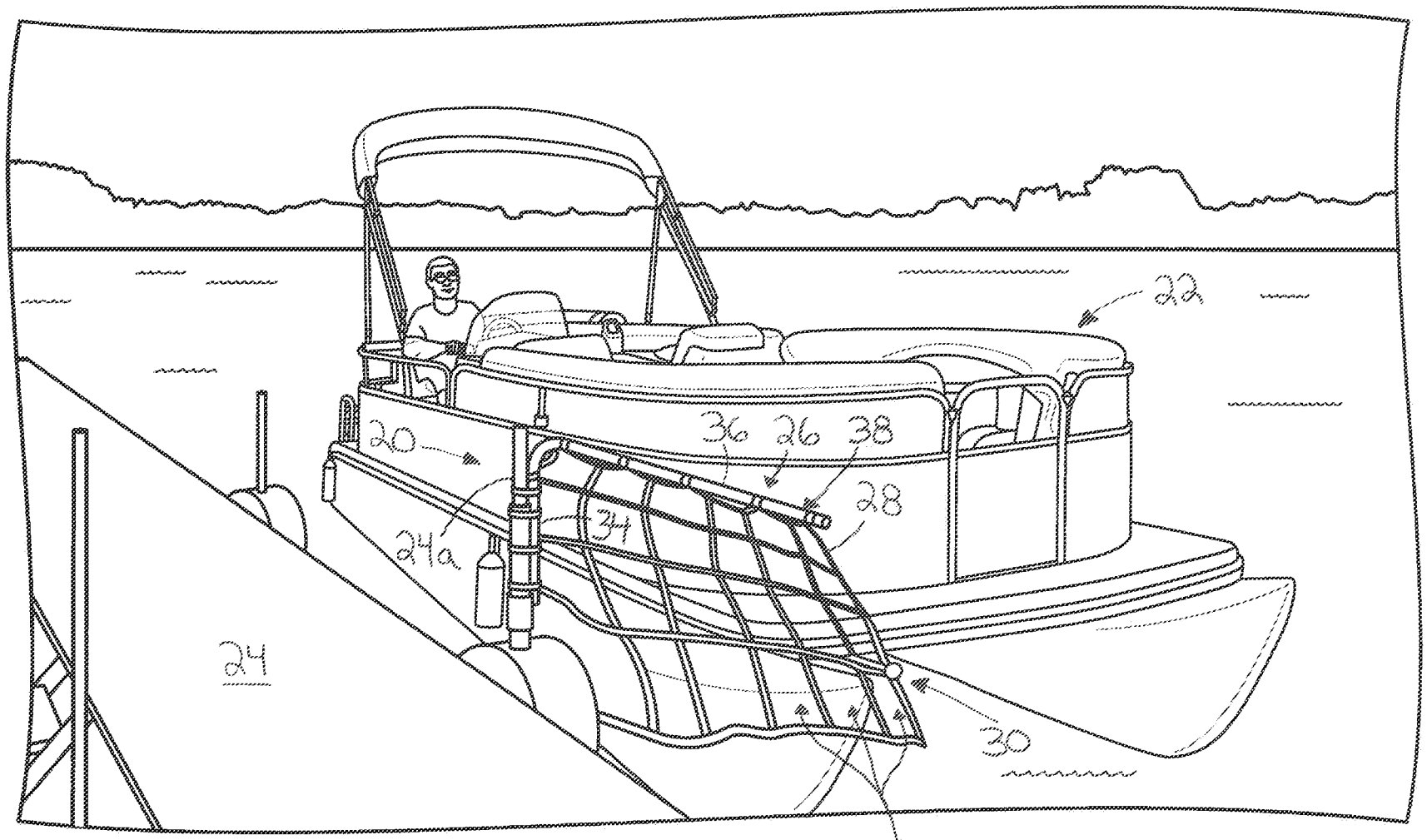
Figure 1E:
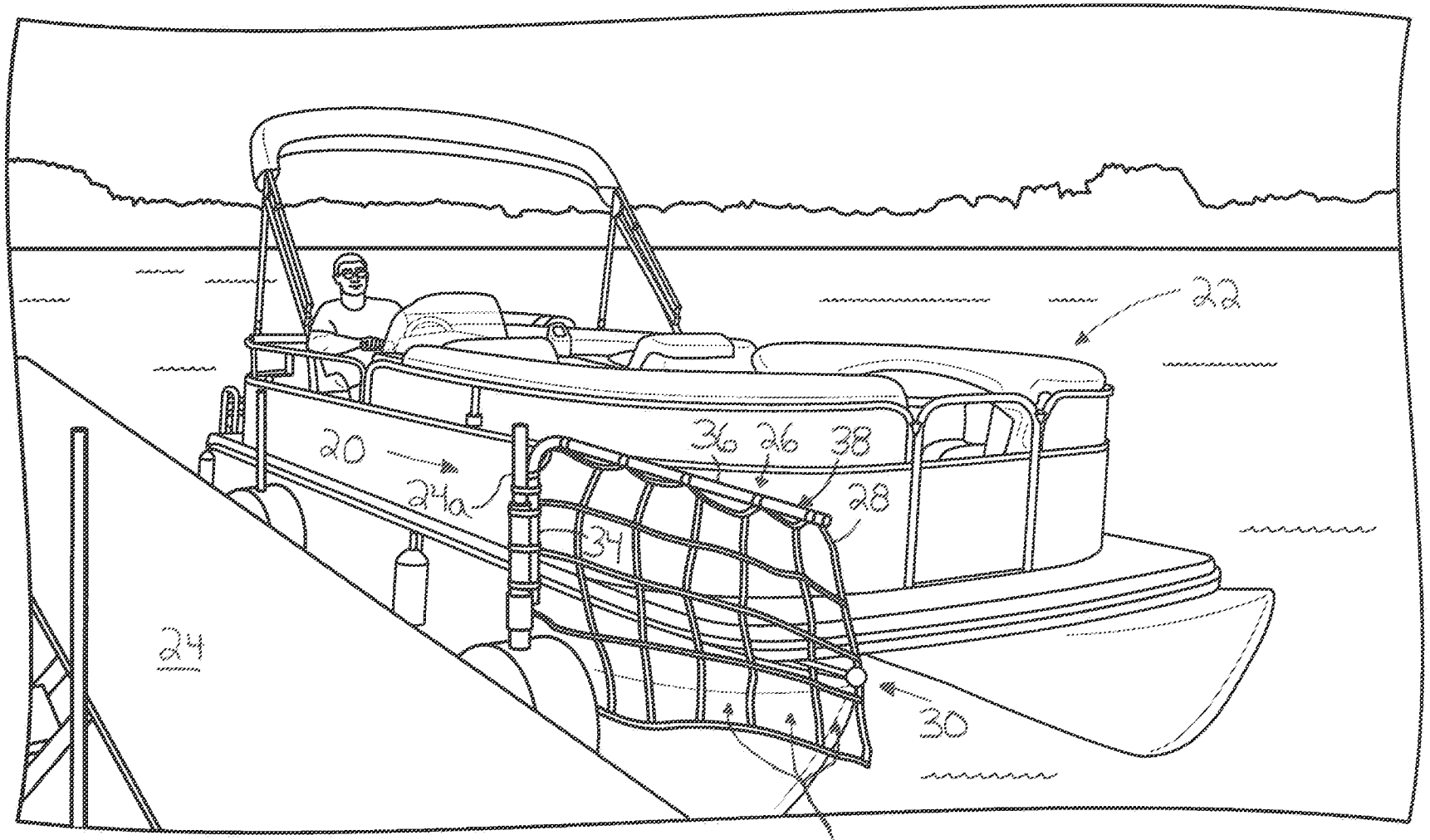

Referring now to the drawings and the illustrative embodiments depicted therein, a boat docking system 20 and method facilitate the boat docking process by initially capturing or ensnaring a bow region of a boat 22 and temporarily holding the boat in place along a dock 24 while ropes or other traditional securing devices are attached between the boat 22 and dock 24, such as shown in FIGS. 1A-1E. This is accomplished by deploying a frame 26 that extends laterally away from dock 24 to support an attached arresting panel in the form of a net 28 over open water adjacent dock 24. The frame-supported net 28 captures and holds the boat 22 in close proximity to the dock 24 during the docking operation. Frame 26 can be coupled to dock 24 and is movable between a deployed position (FIG. 1A) and a non-deployed position similar to the positions shown in FIGS. 1D and 1E. In the deployed position of FIG. 1A, frame 26 is oriented generally perpendicular to dock 24. In a non-deployed position, frame 26 is oriented generally parallel to dock 24. During the docking operation, a protrusion 30 connected to boat 22 is received and captured in an opening 32 of net 28, as shown in FIGS. 1B-1E. Boat 22 will remain captured by net 28 and in close proximity to dock 24 as shown in FIGS. 1D and 1E, thereby allowing the boat operator to exit and secure boat 22 to dock 24 through additional means, such as by tying boat 22 to dock 24 with ropes. The boat docking system 20 provides a safer and more convenient option to facilitate the boat docking process, particularly for solo boat operators.

Figure 2:
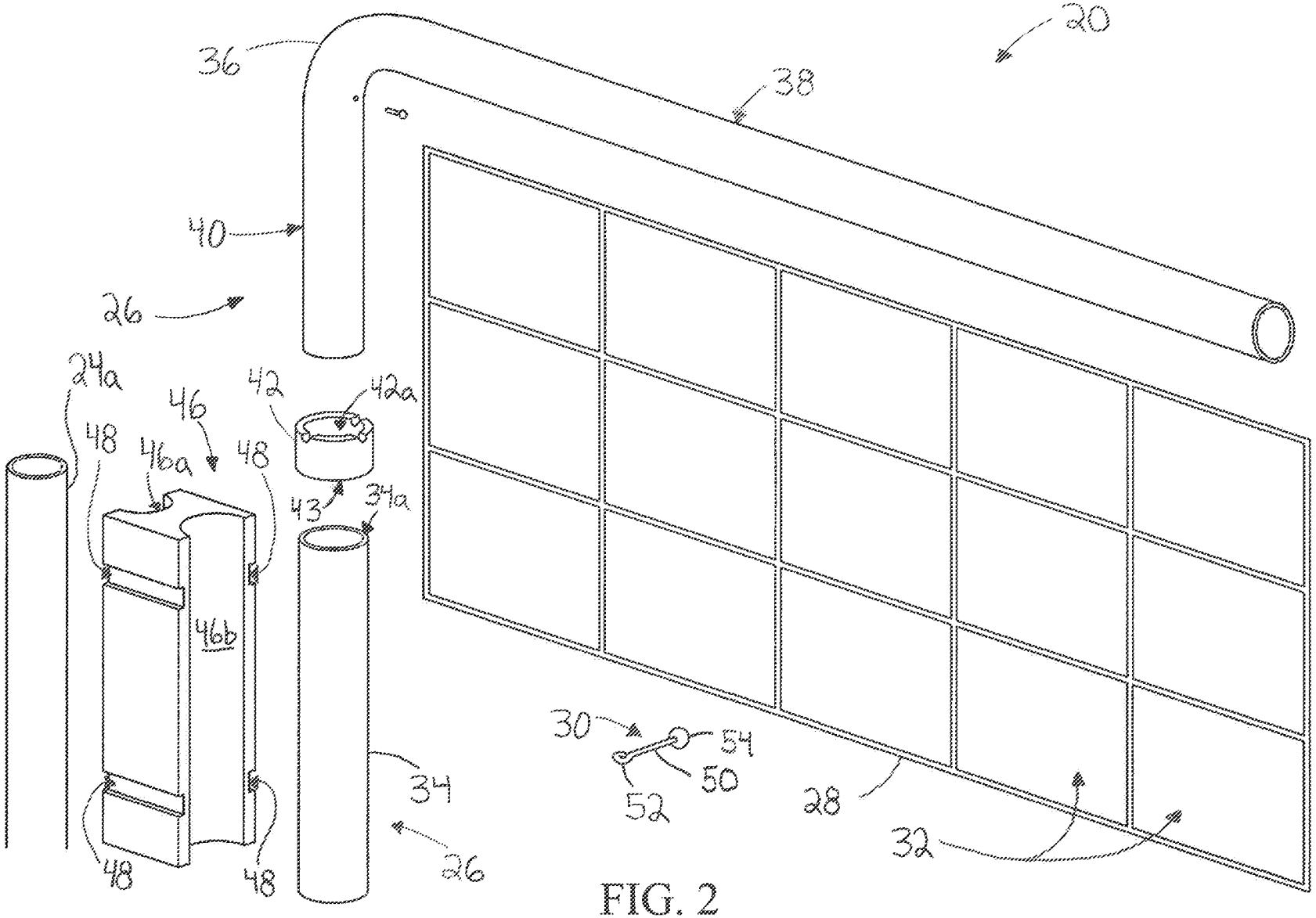
FIG. 2 is an exploded perspective view of a boat docking system that is substantially similar to that of FIG. 1.
Figure 4:
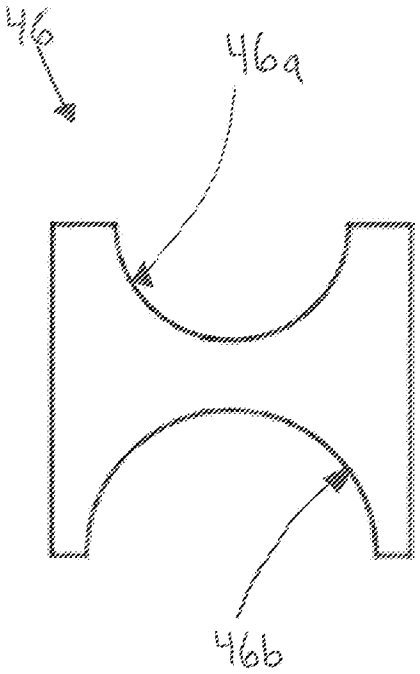
FIG. 4 is a top plan view of the connector of FIG. 3.
Figure 3:
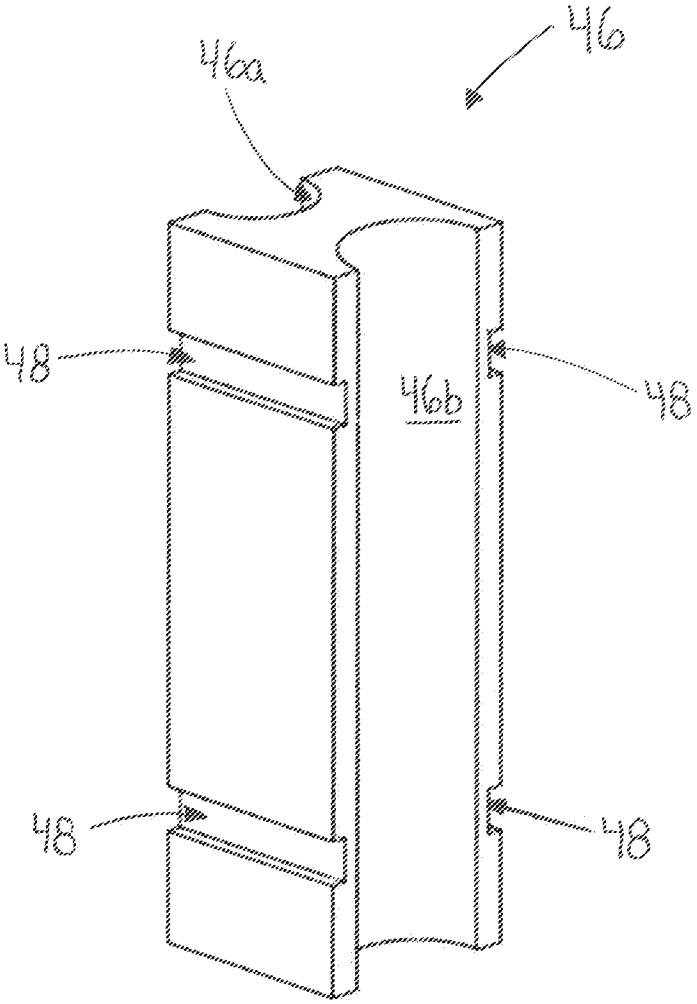
FIG. 3 is an enlarged perspective view of a connector of the boat docking system of FIG. 2.

Referring now to FIG. 2, frame 26 includes a vertical post 34 and a lateral arm 36. Lateral arm 36 includes a horizontal portion 38 and an upright portion 40. A cap 42 couples vertical post 34 to the lateral arm's upright portion 40, and defines a cap cavity 42*a* having upper and lower regions. A connector 46 is provided for pivotably securing vertical post 34 to a dock post 24*a* (or other fixed object), and has a dock post seating surface 46*a* for receiving dock post 24*a* on one side, and a vertical post seating surface 46*b* for receiving vertical post 24 on the opposite side. (FIGS. 2-4). Net 28 is attached to and supported by frame 26 using mechanical fasteners or by threading frame 26 through loops or openings around a periphery of net 28. Protrusion 30, which attaches to boat 22, includes a shaft 50 defining an eyelet 52 at a proximal end, with a bulbous ball-end 54 at a distal end of shaft 50. The bulbous distal end 54 is received through one of the openings 32 in net 28 during the docking process, as will be described below.

Figure 7:
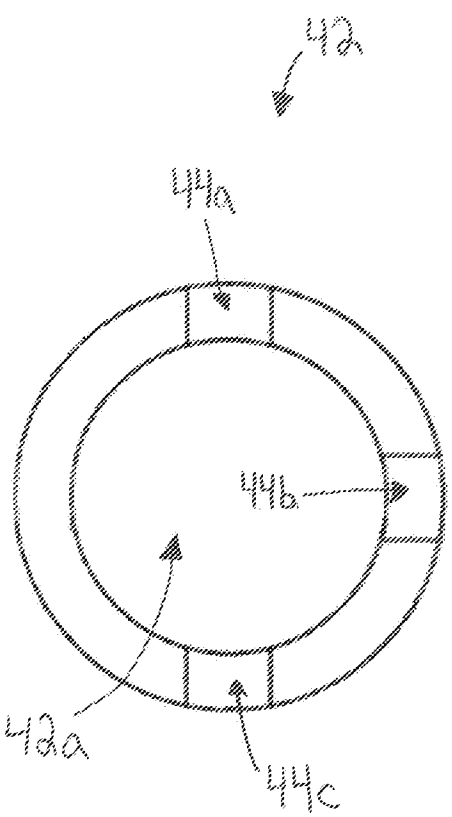
FIG. 7 is a top plan view of the cap of FIG. 5.
Figure 6:
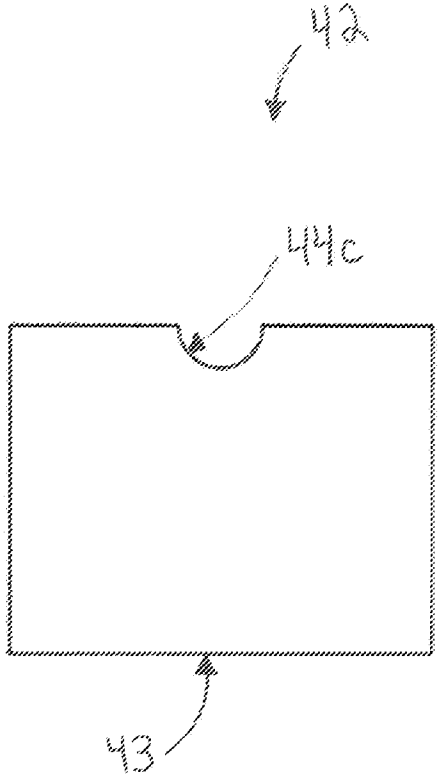
FIG. 6 is a side elevation view of the cap of FIG. 5.
Figure 5:
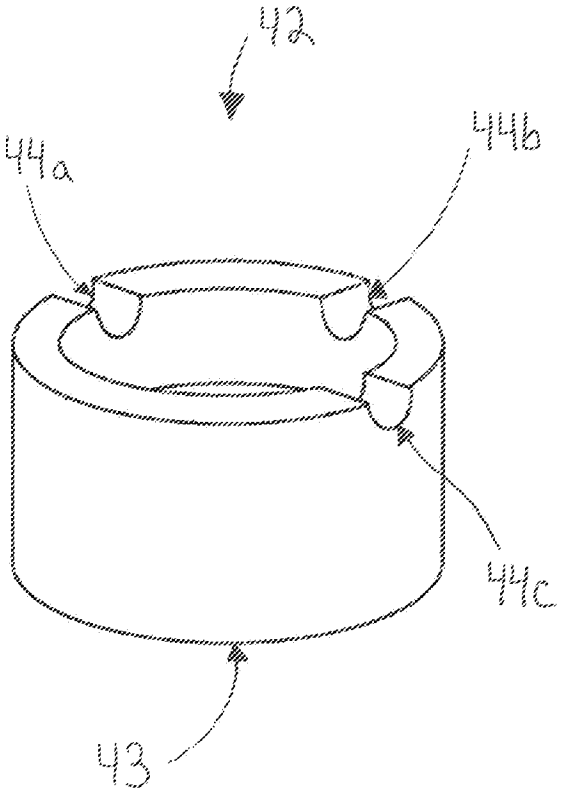
FIG. 5 is an enlarged perspective view of a cap of the boat docking system of FIG. 2
Figure 8:
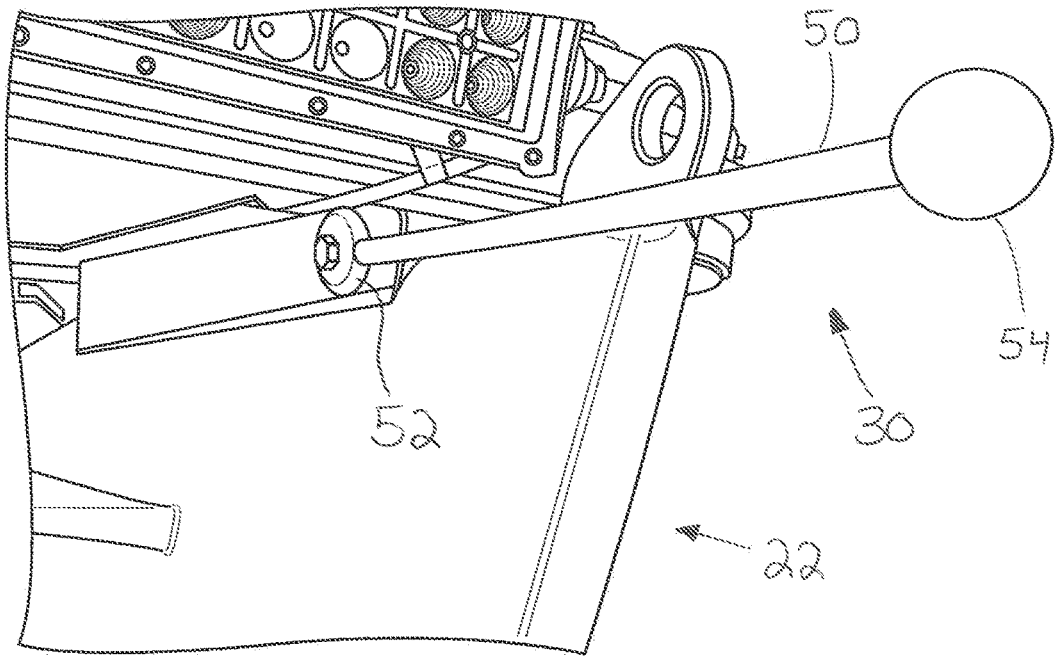
FIG. 8 is a perspective view a protrusion of the boat docking system of FIG. 1, shown attached to an inboard side of a port-side pontoon near the bow of the boat.

An upper surface 34*a* of vertical post 34 rests against a lower cap surface 43 of cap 42 within the lower region of cap cavity 42*a* (FIGS. 2, 5 and 7). A lower end of upright portion 40 fits into the upper region of cap cavity 42*a*. As shown in FIGS. 5-7, cap 42 includes three detents 44*a-c* disposed circumferentially in 90 and 180 degree increments relative to one another. Lateral arm 36 is rotatable about the longitudinal axis of cap 42 and vertical post 34. When the boat docking system 20 is not in use, lateral arm 36 can be rotated such that a detent feature (not shown) on the outer surface of the lateral arm's upright portion 40 engages with first parallel detent 44*a*, thereby releasably retaining lateral arm 36 in a first parallel (undeployed) position relative to dock 24. Optionally, lateral arm 36 can be releasably retained in a second parallel position relative to dock 24, in which lateral arm 36 is further rotated 180 degrees relative to first parallel position when registered with the first detent 44*a*, to engage the detent mechanism with third parallel detent 44*c*. To deploy boat docking system 20, lateral arm 36 can be rotated until the detent mechanism engages with a second (perpendicular) detent 44*b*, thereby releasably retaining lateral arm 36 in a perpendicular position relative to dock 24.

It should be appreciated that various other structures or mechanisms may serve the purpose of detents as described herein. As such, any device or mechanism which provides a resistive force to motion until sufficient force is applied to disengage the device or mechanism may serve this purpose. For example, alternative detents could take the form of a spring-loaded peg that rests in a groove and resists motion until it is released from the groove upon the spring force being overcome. Likewise, another alternative detent could take the form of a pair or set of magnets that resist motion relative to one another until the magnetic force is overcome. Optionally, the frame may omit any detents and rely upon friction to resist pivoting movements as desired.

The rotational position of lateral arm 36 could also be adjusted through electronic means. For example, a controller and a motor could be mounted to vertical post 34. The motor could be located inside cap 42 and exert a rotational force on lateral arm 36 in response to a signal from the controller, thereby causing the rotation of lateral arm 36 relative to the longitudinal axis of cap 42 and vertical post 34. The controller could be a wireless controller, whereby a receiver located within cap 42 would receive a wireless signal from the controller to command the motor to rotate lateral arm 36.

Lateral arm 36 could also be configured to provide an additional counter-rotational force while a boat is being captured by net 28. In this alternative form, a boat docking system could include a counter-rotation mechanism, such as a torsion spring, that is connected between a lateral arm and a cap. The torsion spring could bias the lateral arm in such a way that the lateral arm rotates back against a boat while simultaneously urging the boat towards a dock. A boat docking system with a counter-rotation mechanism may further facilitate the ability to keep a boat captured by a net and also assist in maintaining the boat in a position against a dock.

Connector 46 defines a set of grooves 48 for receiving a hose clamp, rope, strap, or the like, which can be fastened around the perimeter of connector 46, vertical post 34, and dock post 24*a* while vertical post 34 and dock post 24*a* are both seated in their respective seating surfaces 46*b*, 46*a* of connector 46. Although the seating surfaces 46*a*, 46*b* are illustrated as semi-cylindrical cutouts or recesses, it should be appreciated that the shape of the seating surfaces may vary widely to accommodate different shapes and sizes of objects sought to be coupled together by a connector. For example, a square dock post could fit into a square seating surface. Optionally, a connector may have no recessed seating surfaces at all, and could instead take the form of a bracket that connects vertical post 34 to dock post 24*a* through fasteners such as bolts or screws. Further, it is envisioned that cap 42 or lateral arm 36 could be mounted directly to a dock post, or any portion of a dock, in which case the boat docking system would not need to include a vertical post or a connector, while remaining within the spirit and scope of the present invention.

Moreover, it will be understood that a net or other arresting panel need only be held or suspended over open water adjacent a dock or similar structure in order to provide an arresting function, and need not be supported by an L-shaped frame as disclosed in the illustrated embodiments. For example, a frame or other suitable net support may include an angled arm that extends upwardly and laterally away from a dock and over open water. Furthermore, a frame may include only a horizontal or lateral portion that is attached, for example, to a dock post.

Net 28 can be attached to frame 26 using a series of threaded fasteners that protrude through a holes or grommets in the net material and thread into complimentary threaded bores along frame 26. Alternatively, fasteners such as hook-and-loop fasteners, adhesives, or an elastic member and/or cordage such as bungee cords could be used to attach net 28 to frame 26. As a safety feature, the devices used to attach net 28 to frame 26, or the net material itself, may permit net 28 to tear or break away or become disconnected from frame 26 if sufficient downward or lateral force is applied to net 28. Alternatively, net 28 may be made of a frangible material that could tear away from frame 26 at or above a predetermined load. Therefore, in the event that an individual is climbing or playing on, or inadvertently becomes tangled in net 28, or if a boat were to approach with too much speed and energy that it could damage boat docking system 20 or dock 24, the attachment devices securing net 28 to frame 26 will release or the net may tear. Further, a net may be made of a rigid material, or have a weight or a rigid material attached to it such that the net resists deformation during windy conditions.

Referring to FIGS. 2 and 8-10, protrusion 30 can be easily mounted and removed from boat 22 via eyelet 52. For example, eyelet 52 could be mounted to boat 22 by placing it so that a bolt can be inserted through the opening of eyelet 52 and into a boat structure, such as at the bow end of a starboard pontoon as best shown in FIGS. 1A-1E. In this form, eyelet 52 could be further secured to boat 22 by tightening a nut onto the end of the bolt, thereby clamping or capturing eyelet 52 between the nut and the structure of boat 22. Bulbous end 54 facilitates the process of capturing boat 22 by net 28. Once bulbous end 54 has been inserted into one of the openings 32, the spherical and bulging sides of bulbous end 54 resist removal of the protrusion 30 from the net as compared an alternative embodiment in which a protrusion simply terminates in a straight shaft. Shaft 50 extends the location of bulbous end 54 out from boat 22 such that bulbous end 54 reaches net 28 before any other portion of boat 22. In this way, shaft 50 functions to reduce interference from other parts of boat 22 with net 28 upon bulbous end 54 making initial contact with net 28, thereby facilitating the capture of boat 22 by net 28.

Upon receiving protrusion 30 (FIG. 1B) of forward-moving boat 22, net 28 will begin to deform around protrusion 30 due to the force exerted through protrusion 30 as a result of the forward momentum of boat 22 (FIG. 1C). The deformation of net 28 around protrusion 30 and the forward rotation of lateral arm 36 of frame 26 results in the capture of boat 22 (FIG. 1D). While boat 22 remains captured by net 28, lateral arm 36 of frame 26 reaches its maximum forward rotation such that it becomes generally or nearly parallel with dock 24 and halts all forward momentum of boat 22 (FIG. 1E).

The method for docking a boat using boat docking system 20 will already be apparent from the above descriptions, and is summarized hereinbelow. Referring to FIGS. 1A-1E, the boat operator first propels boat 22 on a forward vector and on a trajectory in which protrusion 30 will make contact with net 28. As boat 22 come into close proximity with net 28, the boat's operator adjusts the throttle such that boat 22 is slowly moving forward toward net 28. Protrusion 30 is then received by one of the openings 32 in net 28, and boat docking system 20 arrests the remainder of the forward momentum of boat 22. The boat's engine may be put into a forward gear (typically at idle speed), or may be left in forward gear so that boat 22 remains captured by net 28. The boat's operator may then aim the boat's propeller or rudder away from dock 24 such that the stern of boat 22 swings towards dock 24 until the stern of boat 22 comes to rest alongside dock 24. Then, while keeping boat 22 in gear such that the stern remains in contact with dock 24, the boat's operator exits and further secures boat 22 to dock 24 through additional means, such as tying boat 22 to dock 24 with a rope. Adjustments to this method may include placing the boat's drive system in neutral, or even reverse, and making different adjustments to steering, at different phases of docking and according to weather and water conditions. It should also be understood that boat 22 has been used for illustrative purposes only, and that the boat docking system 20 may be adapted to accommodate a wide variety of watercraft of different shapes and sizes, whether motorized, sail-powered, or human-powered.

Figure 12A:
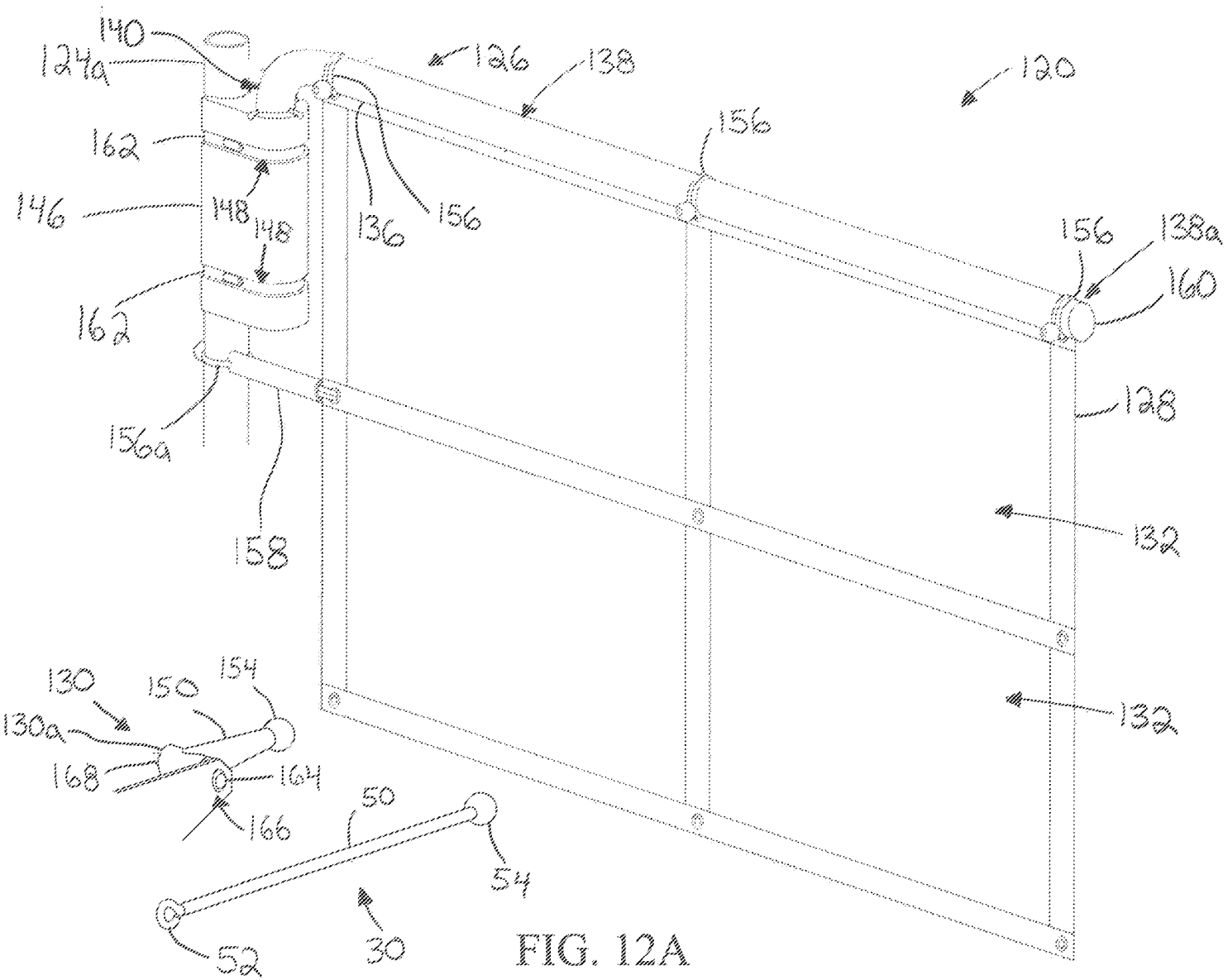
FIG. 12A is a perspective view of another boat docking system in accordance with the present invention.
Figure 12B:
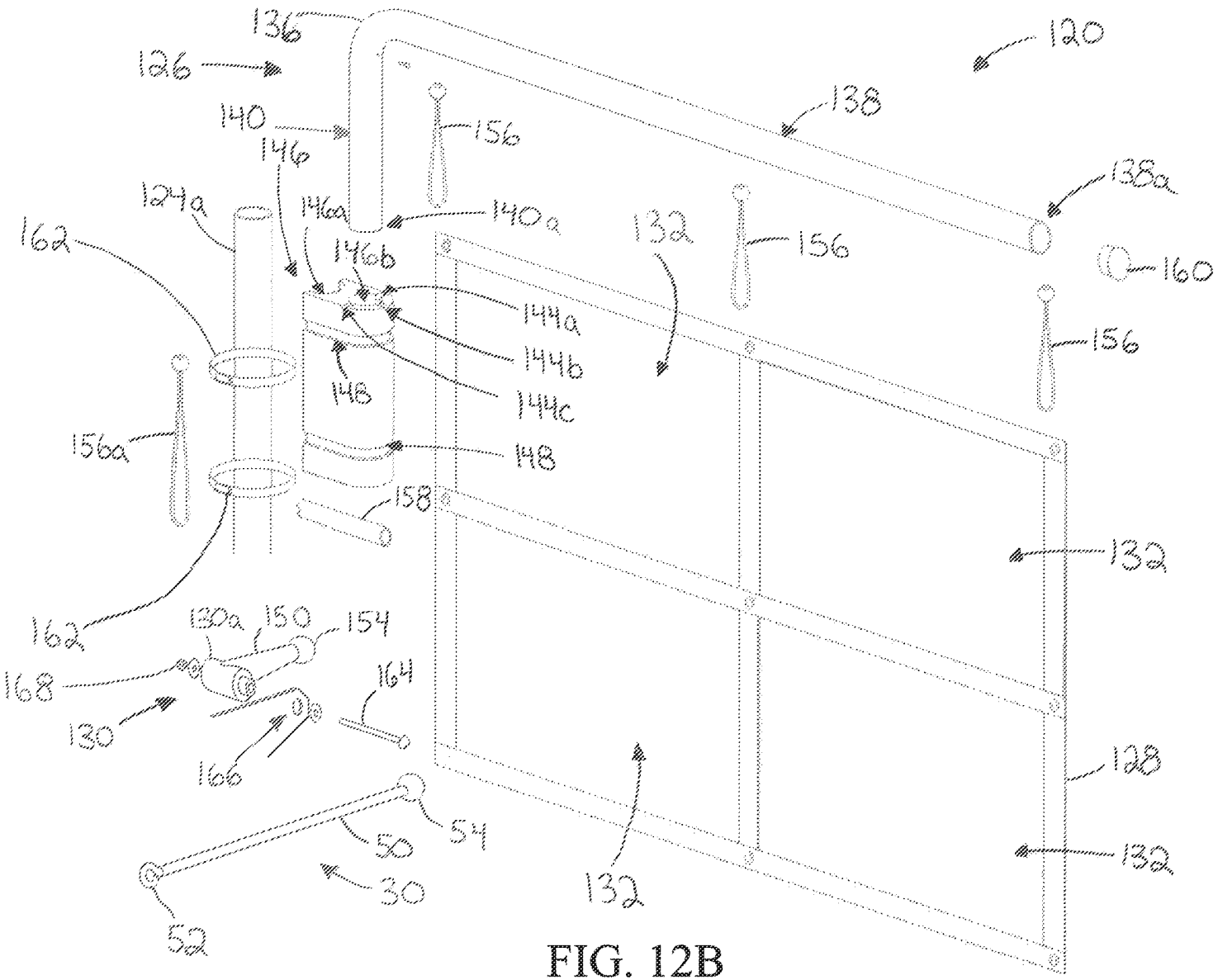
FIG. 12B is an exploded perspective view of the boat docking system of FIG. 12A.

Referring now to the illustrated embodiment of FIGS. 12A and 12B, another boat docking system 120 is shown utilizing reference numbers corresponding to those of boat docking system 20, with 100 added to each reference number for corresponding components. Boat docking system 120 has a net 128 with fewer and larger openings 132 as compared to openings 32 of net 28, thereby potentially making setup and takedown of net 128 easier and more convenient. It should be appreciated that the vertical and/or lateral position of a net may also be adjusted such as by adjusting the position of a frame by using adjustment features that could be incorporated into a boat docking system. Net 128 is attached to a frame 126 via a series of elastic members in the form of bungee cords 156. Another elastic member in the form of a shock absorbing bungee 156*a* is inserted through a sheath 158 and is attached between a dock post 124*a* and net 128. Shock absorbing bungee 156*a* serves to dampen, absorb, and arrest the forward momentum of a boat coming into contact with net 128. Sheath 158 is a rigid or semi-rigid sleeve, and is held between net 128 and dock post 124*a* by shock absorbing bungee 156*a*. Therefore, shock absorbing bungee 156*a* and sheath 158 cooperate to maintain proper spacing between net 128 and dock post 124*a*. If the force and/or momentum of the boat imparted to net 128 is too great, shock absorbing bungee 156*a* will break. In this way, shock absorbing bungee 156*a* will not cause a sudden stop or termination of momentum of the boat, which may cause damage to the boat and/or a dock 124, or cause unanticipated shifting by occupants of the boat. Safety of persons within the vicinity of boat docking system 120 is further increased by a frame end cap 160 mounted at a lateral end 138*a* of a horizontal portion 138 of a lateral arm 136. Frame end cap 160 is made of a soft and/or cushioned material, to improve safety.

Boat docking system 120 also has a connector 146, which integrates the functions of cap 42, vertical post 34, and connector 46 of boat docking system 20 into a single structural component. Dock post 124*a* is seated in a dock post seating surface 146*a* defined by connector 146. An upright portion 140 of a lateral arm 136 is rotatably secured to connector 146 by placing a lower end 140*a* of upright portion 140 into a through hole 146*b* defined by connector 146. A pair of hose clamps 162 are placed in grooves 148 defined by connector 146 and tightened to secure upright portion 140 to dock post 124*a* via connector 146. Connector 146 also defines detents 144*a-c* in a substantially similar manner and to serve the same functional purpose as previously described with regard to detents 44*a-c* of cap 42. In this way, connector 146 efficiently incorporates the functionality of multiple components previously described with respect to boat docking system 20.

Figure 11:
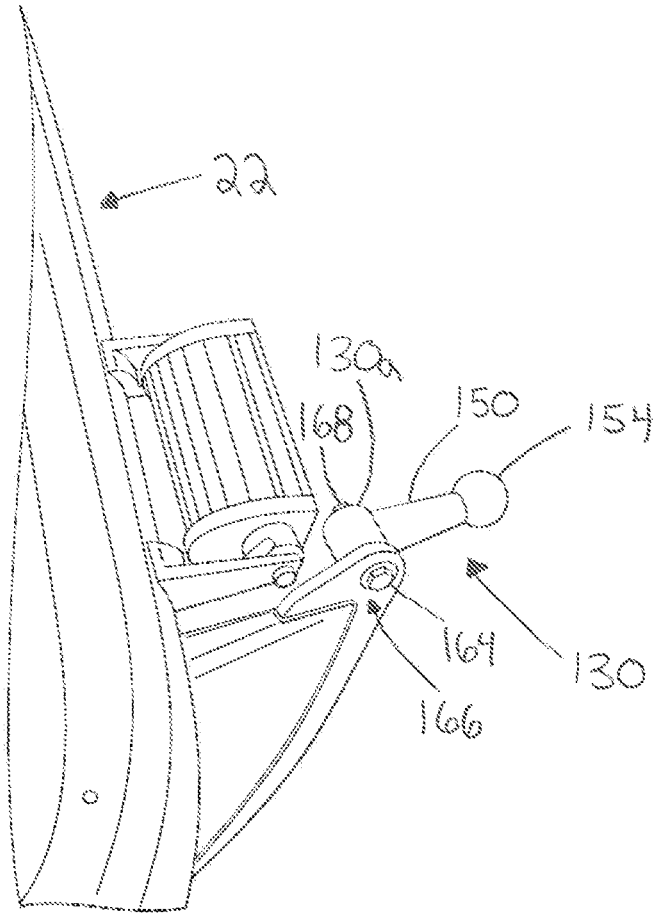
FIG. 11 is a perspective view of an alternative protrusion and boat docking system in accordance with the present invention, shown attached to a pontoon eyelet at the bow of the boat.

It should be understood that different types of a protrusion may be provided to better accommodate different types of boats or the different preferences of boat operators. For example, a boat with a v-shaped bow could have a protrusion with a longer shaft to ensure the end of the protrusion reaches a net before any other portion of the boat. It is also envisioned that boats with V-shaped bows or certain pontoon configurations may not need any additional protrusion, since their pointed front end may be shaped and positioned to be readily captured by a net or other arresting panel. Additionally, rather than terminating in a bulbous end, the protrusion could terminate in an alternative geometry such as a rounded hook or multiple rounded hooks. Furthermore, a protrusion does not need to include an eyelet used for attachment. For example, a shaft of a protrusion may define threads that can be screwed into receiving threads located on or attached to a boat. Alternatively, as shown in FIGS. 11-12B, another protrusion 130 is mounted to a boat by inserting a bolt 164 through a mounting shaft 130*a* and a pontoon eyelet 166, placing a nut 168 on the end of bolt 164, and then tightening bolt 164. Therefore, protrusion 130 is adapted to be mounted in an alternative boat locations, such as the bow end of a pontoon as shown in FIG. 11, and is mounted with alternative fastening features as compared to protrusion 30. Additionally protrusion 130 has a conical-shaped shaft 150 that is shorter and thicker as compared to shaft 50 of protrusion 30, which may give protrusion 130 superior structural strength as compared to protrusion 30.

Figure 9:
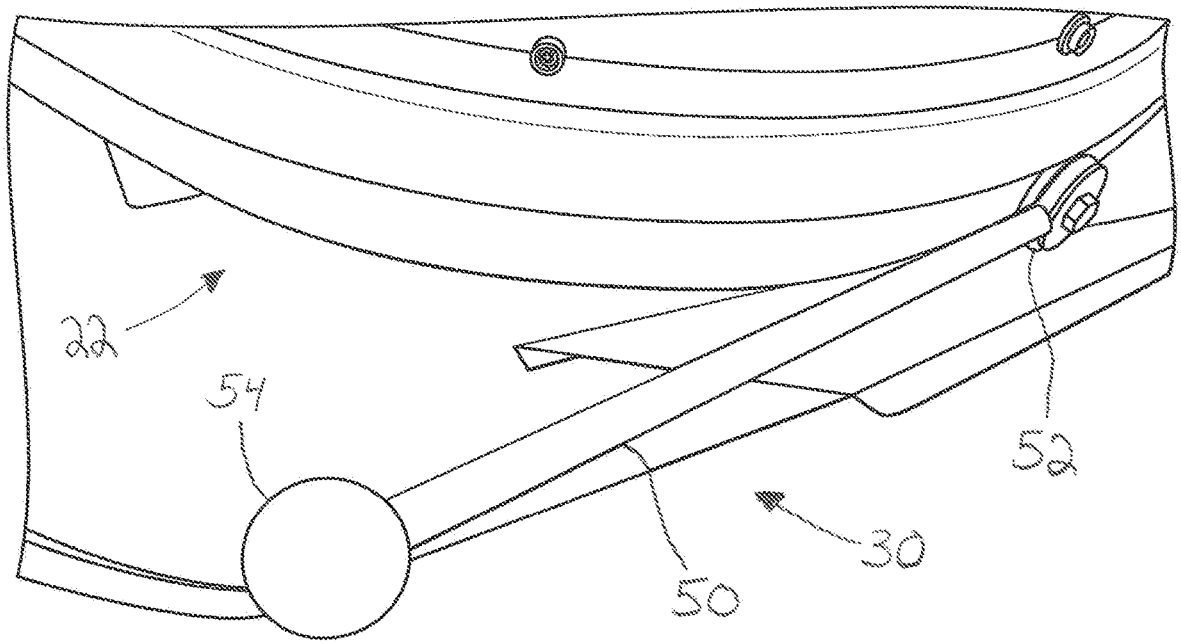
FIG. 9 is a perspective view of the protrusion of FIG. 8, shown attached to an outboard side of a boat platform near the bow of the boat.
Figure 10:
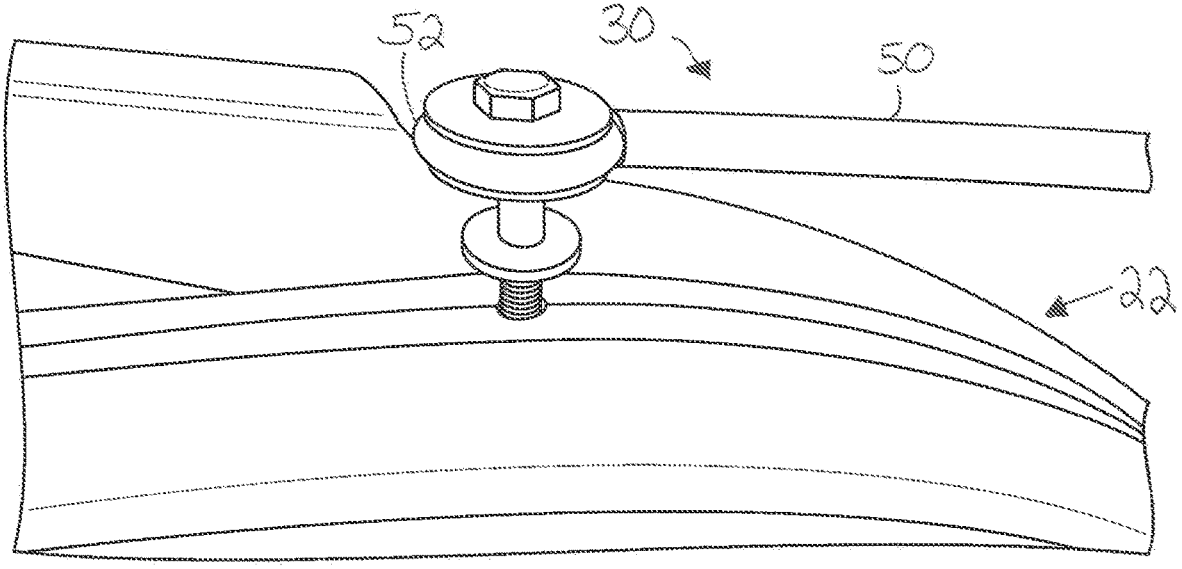
FIG. 10 is a top perspective view of the protrusion and boat platform of FIG. 9.

Moreover, the attachment location of a protrusion on a boat may vary. For example, as shown in FIGS. 9 and 10, a protrusion could be attached on either the starboard side or port side of a boat while still serving its intended function in the boat docking system. It is also envisioned that a net or other flexible panel may have slits that expand or otherwise open upon contact with a protrusion to thereby allow passage of a protrusion through the net. Furthermore, a net or flexible panel may be sized and shaped to be engaged directly by a bow region of a boat, and may not necessarily require the addition of a protrusion to the boat at all.

Accordingly, the boat docking system and method of the present invention facilitates docking boats and other watercraft. The present invention is particularly useful for a solo boat operator that is attempting to dock a boat without assistance from another person. The boat operator navigates the boat toward the net where the boat is initially captured and the forward momentum of the boat is terminated. The boat remains captured by the net as the boat comes to rest alongside the dock. The boat operator may then exit and fully secure the boat to the dock by other means.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A boat docking system comprising:

a frame comprising a laterally-extending portion;

a connector for coupling said laterally-extending portion to a fixed object; and an arresting panel attached to said frame and defining a plurality of openings for receiving a protrusion associated with a boat;

wherein said arresting panel is configured to deform around the protrusion after a portion of the protrusion has been inserted into one of said openings.

2. The system according to claim 1, wherein said frame comprises a vertical portion coupled to said laterally-extending portion, and wherein said arresting panel is coupled to said vertical portion and said laterally-extending portion.

3. The system according to claim 2, wherein said vertical portion is configured to rotate about its longitudinal axis.

4. The system according to claim 2, wherein said laterally-extending portion is configured to rotate about a longitudinal axis of said vertical portion.

5. The system according to claim 4, wherein said connector comprises a detent configured to selectively resist rotational movement of said laterally-extending portion.

6. The system according to claim 4, further comprising a cap for coupling said vertical portion to said laterally-extending portion, and wherein said cap comprises a detent configured to selectively resist rotational movement of said laterally-extending portion.

7. A boat docking system comprising:

a frame comprising a laterally-extending portion, wherein said frame is vertically and horizontally adjustable;

a connector for coupling said laterally-extending portion to a fixed object; and an arresting panel attached to said frame and defining an opening for receiving a protrusion associated with a boat.

8. The system according to claim 7, further in combination with said protrusion, wherein said protrusion comprises a bulbous distal end.

9. A boat docking system comprising:

a frame comprising a laterally-extending portion;

a connector for coupling said laterally-extending portion to a fixed object; and an arresting panel attached to said frame and defining an opening for receiving a protrusion associated with a boat;

wherein said arresting panel is made of a frangible material that is configured to tear or separate from said frame at or above a pre-determined load.

10. A boat docking system comprising:

a frame comprising a laterally-extending portion and a vertical portion coupled to said laterally-extending portion, wherein said laterally-extending portion is configured to rotate about a longitudinal axis of said vertical portion;

a connector for coupling said laterally-extending portion to a fixed object; and an arresting panel attached to said frame and defining an opening for receiving a protrusion associated with a boat.

11. A boat docking system comprising:

a frame comprising an upright portion and a laterally-extending portion, wherein said laterally-extending portion is configured to rotate about a longitudinal axis of said upright portion;

a connector configured to couple said frame to a fixed object;

a protrusion comprising a shaft having a proximal end and a distal end, said proximal end configured for coupling to a boat; and an arresting panel attached to said upright portion and said laterally-extending portion, and defining an opening for receiving said protrusion.

12. The system according to claim 11, further comprising:

an elastic member coupled between the fixed object and said arresting panel; and a rigid sheath;

wherein said elastic member passes through said sheath and pulls said arresting panel and the fixed object into contact with opposing ends of said sheath.

13. The system according to claim 12, wherein said connector comprises a first detent configured to selectively resist rotational movement of said frame.

14. The system according to claim 13, wherein said connector further comprises second and third detents, wherein said second detent is disposed circumferentially 90 degrees from said first detent, and wherein said third detent is disposed circumferentially 180 degrees from said first detent.

15. The system according to claim 14, wherein said connector defines a through hole adapted to receive said upright portion to rotatably couple said frame to said connector.

16. A method of docking a watercraft, said method comprising:

idling a watercraft along a forward vector;

inserting a protrusion of the watercraft into an opening defined in an arresting panel that extends over open water adjacent a dock, wherein the arresting panel is attached to a frame that is attached to a dock;

arresting the forward vector of the watercraft with the arresting panel, wherein said arresting comprises rotating a laterally-extending portion of the frame about a longitudinal axis of an upright portion of the frame; and securing the watercraft to the dock with a rope.

17. The method of claim 16, further comprising steering the watercraft, after said arresting the forward vector, to urge a stern of the watercraft into contact with the dock.

18. The system of claim 9, wherein said frame further comprises a vertical portion coupled to said laterally-extending portion, and wherein said laterally-extending portion is configured to rotate about a longitudinal axis of said vertical portion.

19. The system of claim 10, wherein said frame is vertically and horizontally adjustable.

20. The system of claim 10, wherein said opening is a plurality of openings, and wherein said arresting panel is configured to deform around the protrusion after a portion of the protrusion has been inserted into one of said openings.

* * * * *